US008305006B2

(12) United States Patent
Ishii et al.

(10) Patent No.: US 8,305,006 B2
(45) Date of Patent: Nov. 6, 2012

(54) LIGHT EMITTING ELEMENT CONTROL CIRCUIT

(75) Inventors: Takaaki Ishii, Higashi Osaka (JP); Nobuyuki Ohtaka, Kadoma (JP)

(73) Assignees: Semiconductor Components Industries, LLC, Phoenix, AZ (US); Sanyo Semiconductor Co., Ltd., Gunma (JP)

( * ) Notice: Subject to any disclaimer, the term of this patent is extended or adjusted under 35 U.S.C. 154(b) by 842 days.

(21) Appl. No.: 12/200,752

(22) Filed: Aug. 28, 2008

(65) Prior Publication Data

US 2009/0066263 A1 Mar. 12, 2009

(30) Foreign Application Priority Data

Aug. 29, 2007 (JP) ..... 2007-222429

(51) Int. Cl.
*H05B 37/02* (2006.01)

(52) U.S. Cl. ..... 315/291

(58) Field of Classification Search ..... 315/291, 315/209 R, 209 T, 225, 224
See application file for complete search history.

(56) References Cited

U.S. PATENT DOCUMENTS

| | | | | |
|---|---|---|---|---|
| 6,016,038 | A * | 1/2000 | Mueller et al. | 315/291 |
| 6,218,788 | B1 * | 4/2001 | Chen et al. | 315/225 |
| 6,272,160 | B1 * | 8/2001 | Stronczer | 372/38.02 |
| 7,180,919 | B2 * | 2/2007 | Kurusu | 372/29.01 |
| 7,777,573 | B2 * | 8/2010 | Lee | 330/296 |
| 7,944,153 | B2 * | 5/2011 | Greenfeld | 315/291 |
| 2005/0057554 | A1 * | 3/2005 | Yamamoto et al. | 345/211 |
| 2006/0017409 | A1 * | 1/2006 | Hsieh | 315/360 |
| 2007/0126757 | A1 * | 6/2007 | Itoh et al. | 345/690 |
| 2008/0238327 | A1 * | 10/2008 | Cho et al. | 315/169.3 |
| 2009/0195700 | A1 * | 8/2009 | Yun | 348/723 |

FOREIGN PATENT DOCUMENTS

| | | |
|---|---|---|
| JP | 63-280568 | 11/1988 |
| JP | 2003-264316 | 9/2003 |
| JP | 2006-040975 | 2/2006 |
| JP | 2006-186277 | 7/2006 |
| JP | 2006-339458 | 12/2006 |
| JP | 2007-180388 | 7/2007 |
| JP | 2006-054362 | 2/2009 |

OTHER PUBLICATIONS

Japan Patent Office, Notification of Reasons for Rejection for Application No. 2007-222429, Mail Date Mar. 6, 2012.

* cited by examiner

*Primary Examiner* — Douglas W Owens
*Assistant Examiner* — Amy Yang
(74) *Attorney, Agent, or Firm* — SoCal IP Law Group LLP; Steven C. Sereboff; John E. Gunther

(57) ABSTRACT

A light emitting element control circuit comprising: a variable current generation circuit configured to generate a variable current varying in a direction of increase or in a direction of decrease; a fixed current generation circuit configured to generate a fixed current smaller than a predetermined current of a light emitting element; and a mode setting circuit configured to selectively set a first mode of prohibiting supply of the variable current and the fixed current to the light emitting element, a second mode of supplying the variable current to the light emitting element, and a third mode of supplying the fixed current to the light emitting element, for the variable current generation circuit and the fixed current generation circuit.

6 Claims, 7 Drawing Sheets

LIGHT EMITTING ELEMENT CONTROL CIRCUIT

CROSS-REFERENCE TO RELATED APPLICATION

This application claims the benefit of priority to Japanese Patent Application No. 2007-222429, filed Aug. 29, 2007, of which full contents are incorporated herein by reference.

BACKGROUND OF THE INVENTION

1. Field of the Invention

The present invention relates to a light emitting element control circuit.

2. Description of the Related Art

Light emitting elements such as LED (light emitting diode) and organic EL (electro luminance) elements are used as light emitting sources, for example, backlights of liquid crystal displays, illumination lights of operation buttons, and operation display lights, of electronic devices such as cellular telephones and liquid crystal televisions, of which advanced functions have significantly been required in recent years (see Japanese Patent Application Laid-Open Publication No. 2003-264316).

To achieve objects of enhancing visual effects or presentation effects when notifying users of incoming telephone calls and incoming e-mails, and of taking energy conservation measures of back light in standby mode, for example, the light emitting elements provided as the light emitting sources of the above electronic devices are required to appropriately set patterns of the light emission state depending on uses, so as to achieve more advanced functions of the electronic devices.

SUMMARY OF THE INVENTION

A light emitting element control circuit according to an aspect of the present invention, comprises: a variable current generation circuit configured to generate a variable current varying in a direction of increase or in a direction of decrease; a fixed current generation circuit configured to generate a fixed current smaller than a predetermined current of a light emitting element; and a mode setting circuit configured to selectively set a first mode of prohibiting supply of the variable current and the fixed current to the light emitting element, a second mode of supplying the variable current to the light emitting element, and a third mode of supplying the fixed current to the light emitting element, for the variable current generation circuit and the fixed current generation circuit.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

==First Embodiment==

<<Configuration of Light Emitting Element Control Circuit>>

Figure 1:
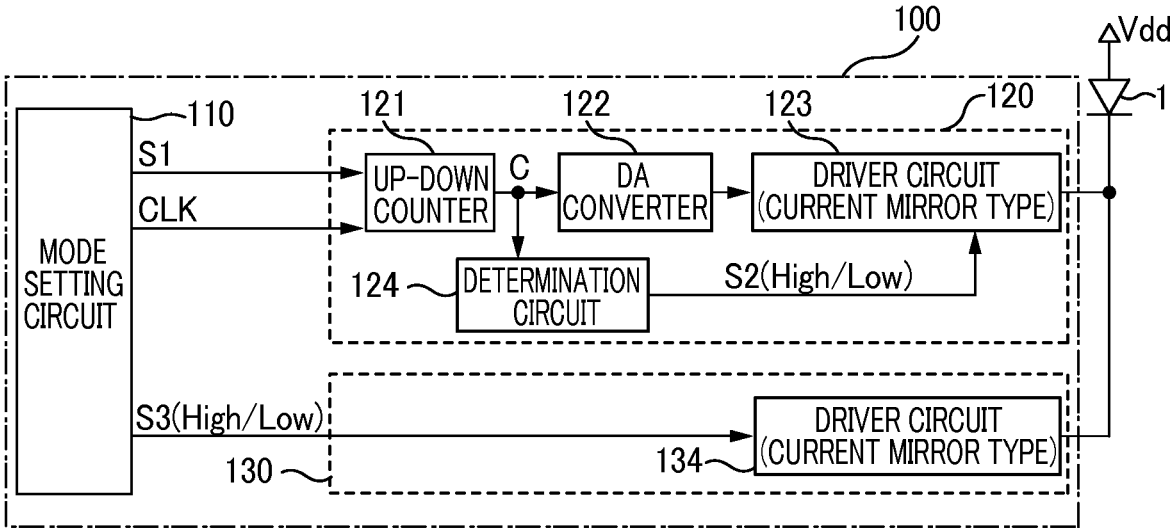
FIG. 1 is a block diagram of a configuration of a light emitting element control circuit according to a first embodiment of the present invention.

FIG. 1 is a block diagram of an overall configuration of a light emitting element control circuit controlling luminance of an LED 1 according to a first embodiment of the present invention by controlling a drive current supplied to the LED 1. In FIG. 1, a light emitting element control circuit 100 is a configuration surrounded by alternate long and short dashed lines.

In FIG. 1, the light emitting element control circuit 100 includes a mode setting circuit 110, a variable current generation circuit 120, and a fixed current generation circuit 130. As shown in FIG. 1, the light emitting element control circuit 100 has a configuration with a driver circuit 123 of the variable current generation circuit 120 and a driver circuit 134 of the fixed current generation circuit 130 connected in parallel with the cathode side of the LED 1.

The variable current generation circuit 120 generates a first variable current varying in a direction of gradual increase and a second variable current varying in a direction of gradual decrease. The variable current generation circuit 120 supplies a first or second variable current to the LED 1 in response to a signal S1 output by the mode setting circuit 110 which will described later. The signal S1 is a signal functioning as a trigger for giving an instruction for starting to supply the first variable current to the LED or starting to supply the second variable current thereto. The luminance of the LED 1 varies depending on magnitude (amount) of the drive current supplied to the LED 1. Therefore, if the variable current generation circuit 120 starts to supply the first variable current to the LED 1, the luminance of the LED 1 is gradually increased at a predetermined rate of change according to the current amount of the first variable current.

A function of performing control for gradually increasing the luminance of the LED 1 to a predetermined lighting state is hereinafter referred to as a fade-in function. If the variable current generation circuit 120 starts to supply the second variable current to the LED 1, the luminance of the LED 1 is gradually decreased at the predetermined rate of change according to the current amount of the second variable current. A function of performing control for gradually decreasing the luminance of the LED 1 from the predetermined lighting state is hereinafter referred to as a fade-out function.

Specifically, the variable current generation circuit 120 includes an up-down counter 121, a DA converter 122, a current-mirror-type driver circuit 123, and a determination circuit 124.

The up-down counter 121 is supplied with the signal S1 for giving the instruction for starting to supply the first variable current to the LED 1 or starting to supply the second variable current thereto form the mode setting circuit 110 and with a counter clock CLK having a predetermined frequency. When the instruction for starting to supply the first variable current is given with the signal S1, the up-down counter 121 counts up with the counter clock CLK to obtain a count value C. On the other hand, when the instruction for starting to supply the second variable current is given with the signal S1, the up-down counter 121 counts down with the counter clock CLK to obtain the count value C.

In an embodiment according to the present invention, the up-down counter 121 is assumed to be configured as a six-bit counter. In this case, the counter counts up from "000000" (0 in decimal number) to "111111" (63 in decimal number) and counts down from "111111" to "000000" to obtain the count value C. The count value C is output from the up-down counter 121 to the DA converter 122 and the determination circuit 124.

The DA converter 122 converts the count value C output by the up-down counter 121 from a digital value into an analog value (current value) and supplies the analog value to the driver circuit 123. Since the up-down counter 121 is a 6 bit counter in an embodiment of the present invention, the analog value output by the DA converter 122 is changed in 64 steps. Therefore, when the up-down counter 121 counts up to obtain the count value C, the driver circuit 123 is supplied with the first variable current varying in the increasing direction in 64 steps. On the other hand, when the up-down counter 121 counts down to obtain the count value C, the driver circuit 123 is supplied with the second variable current varying in the decreasing direction in 64 steps.

The determination circuit 124 determines whether or not the count value C output by the up-down counter 121 is equal to or smaller than a predetermined value. The determination circuit 124 also supplies to the driver circuit 123 a signal S2 that becomes low-level when the count value C is greater than the predetermined value and high-level when the count value C is equal to or smaller than the predetermined value. It is assumed here that the predetermined value is "000000" (0 in decimal number). Therefore, when determining that the count value C is "000000", the determination circuit 124 supplies the signal S2 of high level to the driver circuit 123. That is, when the first variable current and the second variable current are not supplied, the count value C is "000000" and, therefore, the signal S2 becomes high-level. In other words, the signal S2 is low-level during a period from the time when the signal S1 for giving the instruction for starting to supply the first variable current is output to the time when the second variable current is completely supplied in 64 steps in response to the output of the signal S1 for giving the instruction for starting to supply the second variable current.

When the signal S2 supplied from the determination circuit 124 is low level, the driver circuit 123 drives the LED 1 with the first or second variable current supplied from the DA converter 122. That is, if the first variable current is supplied to the driver circuit 123, the first variable current is passed through the LED 1 to perform the fade-in function, and if the second variable current is supplied to the driver circuit 123, the second variable current is passed through the LED 1 to perform the fade-out function.

On the other hand, when the signal S2 supplied from the determination circuit 124 is high level, the driver circuit 123 prohibits the supply of the first or second variable current to the LED 1. That is, if the count value C is equal to or smaller than the predetermined value, the supply of the first or second variable current to the LED 1 is prohibited. In an embodiment according to the present invention, there is prohibited the supply of the first or second variable current to the LED 1 when the count value C is "000000". Therefore, the first or second variable current to be supplied to the LED 1 is not supplied, i.e., a value of the first or second variable current is completely made zero, when the count value C is "000000", regardless of leak currents within the light emitting element control circuit 100, or the like.

The fixed current generation circuit 130 includes the current-mirror-type driver circuit 134 that generates a fixed current smaller than a drive current (predetermined current) with which the LED 1 is driven to be in a predetermined lighting state, to drive the LED 1 with the fixed current. The driver circuit 134 can control supply of the fixed current to the LED 1 as to prohibition in accordance with a signal S3 output by the mode setting circuit 110.

The predetermined lighting state indicates a state of the LED 1 caused to emit light with arbitrary luminance required when lighting the LED 1. For example, the predetermined lighting state indicates a lighting state when the LED 1 is caused to emit light of luminance with which a liquid crystal display is easily viewed at the time of operation of the electronic device, in the case that the LED 1 is used for backlight of the liquid crystal display of an electronic device, etc. Therefore, the predetermined lighting state corresponds to the lighting state of the LED 1 with the luminance highest of the luminance of the LED 1 that can be set by the light emitting element control circuit 100 (hereinafter referred to as full lighting state), the lighting state of the LED 1 with the luminance of 80 percent of the full lighting state, etc. In an embodiment according to the present invention, it is assumed that the predetermined lighting state is the lighting state of the LED 1 when the fixed current and the first variable current in 64-step are completely supplied.

It is preferable that the fixed current is set to such an extent that the LED 1 in a light emission state is visible to a person (hereinafter referred to as weak lighting state). This is because when the current amount of the LED drive current supplied to the LED 1 is minute, the light emitting intensity of the LED 1 becomes very low so that the LED is not discernible with the human eyes.

The mode setting circuit 110 outputs the signal S1 and the counter clock CLK to the variable current generation circuit 120 and outputs the signal S3 to the fixed current generation circuit 130. The signal S1 gives the instruction as to whether the first variable current starts to be supplied or the second variable current starts to be supplied, and the signal S3 gives an instruction as to whether the fixed current is supplied or prohibited.

Therefore, the mode setting circuit 110 can output the signal S1 and the signal S3 at arbitrary timing, so as to freely set, for the variable current generation circuit 120 and the fixed current generation circuit 130 for each arbitrary period, at least any one state (mode) among those states: a state where the LED drive current is not supplied to the LED 1 and prohibited (first mode), a state where the first variable current is supplied to the LED 1 (second mode), a state where the second variable current is supplied to the LED 1 (primed second mode), and a state where the fixed current is supplied to the LED 1 (third mode).

<<Detailed Configurations of Variable Current Generation Circuit and Fixed Current Generation Circuit>>

Figure 2:
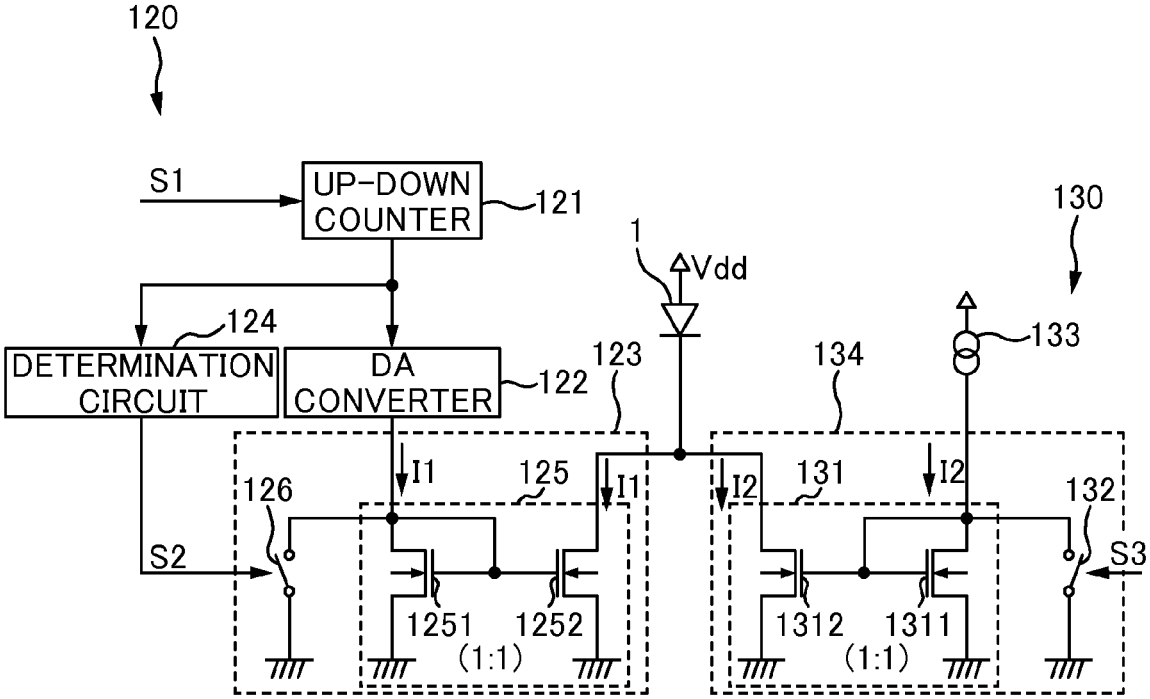
FIG. 2 is a diagram of detailed configurations of a variable current generation circuit and a fixed current generation circuit of a light emitting element control circuit according to a first embodiment of the present invention.

FIG. 2 is a diagram of detailed exemplary configurations of the variable current generation circuit 120 and the fixed current generation circuit 130 according to a first embodiment of the preset invention. In FIG. 2, the constituent elements same as those of FIG. 1 are given the same reference numerals and description thereof will be omitted.

The current-mirror-type driver circuit 123 includes a first current mirror circuit 125 and a first switch 126.

The first current mirror circuit 125 is so configured as to connect each of gate electrodes of an nMOSFET 1251, which is short-circuited and diode-connected between the drain electrode and the gate electrode, and an nMOSFET 1252, and to ground each of source electrodes. In an embodiment according to the present invention, a mirror ratio of the first current mirror circuit 125 is assumed to be 1:1.

The drain electrode of the nMOSFET 1251 is connected to the DA converter 122 and the drain electrode of the nMOSFET 1252 is connected to a power source Vdd through the LED 1. Therefore, when the first or second variable current (current I1 of FIG. 2) according to an analog value output by the DA converter 122 is passed as a drain current of the nMOSFET 1251, the first or second variable current is duplicated and passed as a drain current of the nMOSFET 1252. As a result, the first or second variable current is supplied to the LED 1.

The first switch 126 is turned on/off by the signal S2 to switch as to whether the analog value output by the DA converter 122 is supplied to the first current mirror circuit 125. One end of the first switch 126 is connected to the drain electrode of the nMOSFET 1251 and the other end is grounded. The first switch 126 is turned on when the signal S2 of high level is supplied. When the first switch 126 is turned on, the first or second variable current according to the analog value output by the DA converter 122 is passed to ground potential GND through the first switch 126. Therefore, the first or second variable current is not duplicated as the drain current of the nMOSFET 1251 making up the first current mirror circuit 125, and thus, the supply of the first or second variable current to the LED 1 is prohibited.

On the other hand, the first switch 126 is turned off when the signal S2 of low level is supplied. When the first switch 126 is turned off, the first or second variable current according to the analog value output by the DA converter 122 is duplicated as the drain current of the nMOSFET 1252 making up the first current mirror circuit 125, and therefore, the first or second variable current is supplied to the LED 1. The determination circuit 124 and the first switch 126 correspond to a first switch circuit.

The fixed current generation circuit 130 includes a fixed current source 133 that outputs a fixed current of a predetermined magnitude and the driver circuit 134. The fixed current source 133 may be a DA converter that converts a digital signal having magnitude of the fixed current is set therefor by the mode setting circuit 110 into an analog signal.

The current-mirror-type driver circuit 134 includes a second current mirror circuit 131 configured so as to connect each of gate electrodes of an nMOSFET 1311, which is short-circuited and diode-connected between the drain electrode and the gate electrode, and an nMOSFET 1312, and to ground each of the source electrodes. In an embodiment according to the present invention, a mirror ratio of the second current mirror circuit 131 is assumed to be 1:1.

The drain electrode of the nMOSFET 1311 is connected to the fixed current source 133 and the drain electrode of the nMOSFET 1312 is connected to the power source Vdd through the LED 1. Therefore, when the fixed current (current I2 of FIG. 2) supplied from the fixed current source 133 is passed to the nMOSFET 1311, the fixed current is duplicated and passed as the drain current of the nMOSFET 1312. As a result, the fixed current is supplied to the LED 1.

A second switch 132 is connected to the drain electrode of the nMOSFET 1311. The second switch 132 is turned on/off by the signal S3 to control as to whether the fixed current output by the fixed current source 133 is supplied to the second current mirror circuit 131.

Specifically, the second switch 132 is turned on when the signal S3 of high level is supplied. In this case, the fixed current output by the fixed current source 133 is passed to the ground potential GND through the second switch 132. As a result, the fixed current is not duplicated as the drain current of the nMOSFET 1311, and the supply of the fixed current to the LED 1 is prohibited.

On the other hand, the second switch 132 is turned off when the signal S3 of low level is supplied. In this case, the fixed current output by the fixed current source 133 is supplied to the drain electrode of the nMOSFET 1311 and duplicated as the drain current of the nMOSFET 1312, and therefore, the fixed current is supplied to the LED 1.

<<Operation of Light Emitting Element Control Circuit>>

Figure 3:
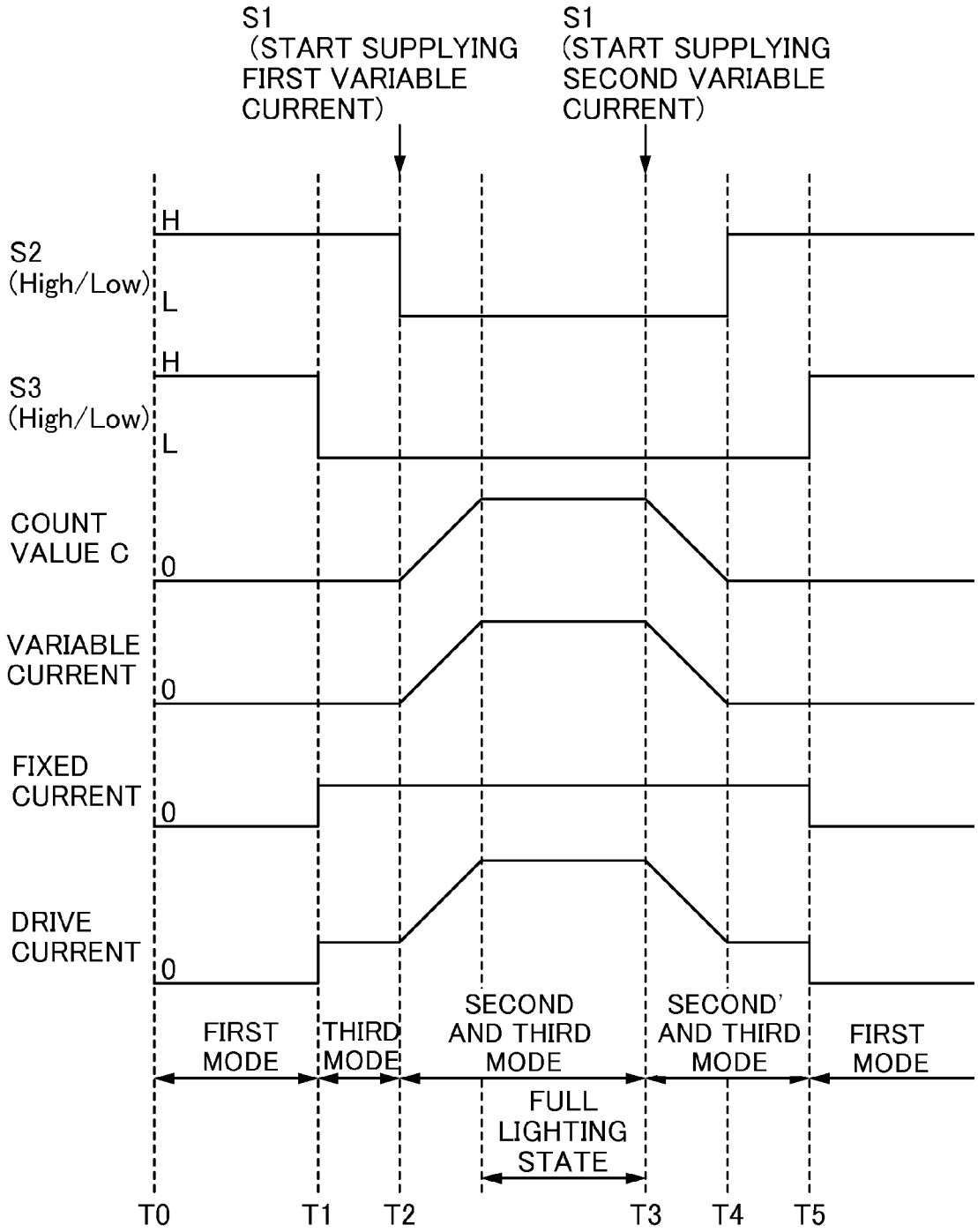
FIG. 3 is a waveform diagram of main signals for explaining an operation of a light emitting element control circuit according to a first and second embodiments of the present invention.

FIG. 3 depicts a case where the mode setting circuit 110 sets the modes for the variable current generation circuit 120 and the fixed current generation circuit 130 in the order of the first mode, the third mode, the second and third modes, the primed second and third modes, and the first mode, as an example of an operation of the light emitting element control circuit 100 according to an embodiment of the present invention.

First, description will be made of a case where the mode setting circuit 110 sets the first mode for the variable current generation circuit 120 and the fixed current generation circuit 130. In this case, the mode setting circuit 110 gives no instruction for starting to supply the first or second variable current by the signal S1. Therefore, since the count value C of the up-down counter 121 is "000000", which corresponds to a state of the count value C being equal to or smaller than the predetermined value, the signal S2 becomes high level. Since the signal S2 is high level, the driver circuit 123 prohibits the supply of the first or second variable current to the LED 1. The mode setting circuit 110 makes the signal S3 high level. As a result, the fixed current generation circuit 130 prohibits the supply of the fixed current to the LED 1. Therefore, the LED 1 is supplied with no LED drive current, i.e., only the first mode is set to achieve a light-out state (see time T0 to T1 of FIG. 3).

Description will then be made of a case where the mode setting circuit 110 sets the third mode for the variable current generation circuit 120 and the fixed current generation circuit 130. In this case, the mode setting circuit 110 gives no instruction for starting to supply the first or second variable current by the signal S1. Therefore, since the count value C of the up-down counter 121 is "000000", which corresponds to a state of the count value C being equal to or smaller than the predetermined value, the signal S2 becomes high level. Since the signal S2 is high level, the driver circuit 123 prohibits the supply of the first or second variable current to the LED 1. The mode setting circuit 110 makes the signal S3 low level. As a result, the LED 1 is supplied with only the fixed current by the fixed current generation circuit 130, i.e., only the third mode is set to achieve a weak lighting state (see time T1 to T2 of FIG. 3).

Description will then be made of a case where the mode setting circuit 110 sets the second and third modes for the variable current generation circuit 120 and the fixed current generation circuit 130. The mode setting circuit 110 outputs the signal S1 for giving the instruction for starting to supply the first variable current to the LED 1 to cause the up-down counter 121 to start to count up. The up-down counter 121 counts up from the count value C of "000000" to the count value C of "111111". Therefore, the count value C becomes greater than the predetermined value, and thus, the signal S2 becomes low level. Since the signal S2 is low level, the driver circuit 123 supplies to the LED 1 the first variable current varying in the direction of the gradual increase in 64 steps. The mode setting circuit 110 makes the signal S3 low level. As a result, the LED 1 is supplied with the fixed current by the fixed current generation circuit 130.

Therefore, the LED drive current is gradually increased with the supply of the first variable current from a state where the fixed current is supplied. That is, after setting the third mode for the variable current generation circuit 120 and the fixed current generation circuit 130, the mode setting circuit 110 outputs the signal S1 for giving the instruction for starting to supply the first variable current to the LED 1 and makes the signal S3 low-level to set the second and third modes, so that the fade-in function is performed, and thus, the LED 1 is changed from the weak lighting state to the predetermined lighting state (see time T2 to T3 of FIG. 3).

As described above, there can be obtained such a pattern of the light emission state that the LED 1 is changed from the light-out state to the weak lighting state, and then from the weak lighting state to the predetermined lighting state by performing the fade-in function, in accordance with the above mode setting order.

Description will then be made of a case where the mode setting circuit 110 sets the primed second and third modes for the variable current generation circuit 120 and the fixed current generation circuit 130. The mode setting circuit 110 outputs the signal S1 for giving the instruction for starting to supply the second variable current to the LED 1 to cause the up-down counter 121 to start to count down. The up-down counter 121 counts down from the count value C of "111111" to the count value C of "000000". Therefore, the signal S2 is low-level until the count value C reaches the predetermined value "000000", and when the count value C reaches the predetermined value "000000" (see time T4 of FIG. 3), the signal S2 becomes high-level. That is, after supplying to the LED 1 the second variable current varying in the direction of the gradual decrease in 64 steps, the driver circuit 123 prohibits the supply of the second variable current to the LED 1 since the signal S2 is high level. The mode setting circuit 110 makes the signal S3 low level. Therefore, the LED 1 is supplied with only the fixed current by the fixed current generation circuit 130.

Therefore, the LED 1 is changed from the state of receiving the supply of the fixed current and the first variable current to the state of receiving the supply of the fixed current and the second variable current and finally to the state of receiving the supply only of the fixed current. That is, after setting the second and third modes for the variable current generation circuit 120 and the fixed current generation circuit 130, the mode setting circuit 110 outputs the signal S1 for giving the instruction for starting to supply the second variable current to the LED 1 and makes the signal S3 low-level to set the primed second and third modes, so that the fade-out function is performed, and thus, the LED 1 is changed from the predetermined lighting state to the weak lighting state (see time T3 to T5 of FIG. 3).

The mode setting circuit 110 then sets the first mode for the variable current generation circuit 120 and the fixed current generation circuit 130 as described above so that the LED 1 is changed from the weak lighting state to the light-out state.

As described above, there can be obtained such a pattern of a light emission state that the LED 1 is changed from the predetermined lighting state to the weak lighting state by performing the fade-out function and then is changed from the weak lighting state to the light-out state, in accordance with the above mode setting order.

The modes can freely be changed by adjusting the output timing of the signals S1 and S3 of the mode setting circuit 110. Therefore, for example, in the case where power consumption associated with the lighting of the LED 1 is required to be reduced, the third mode can be set first to achieve the weak lighting state where the LED drive current flows having a current amount smaller than the LED drive current for putting the LED 1 into the predetermined lighting state.

Figure 4:
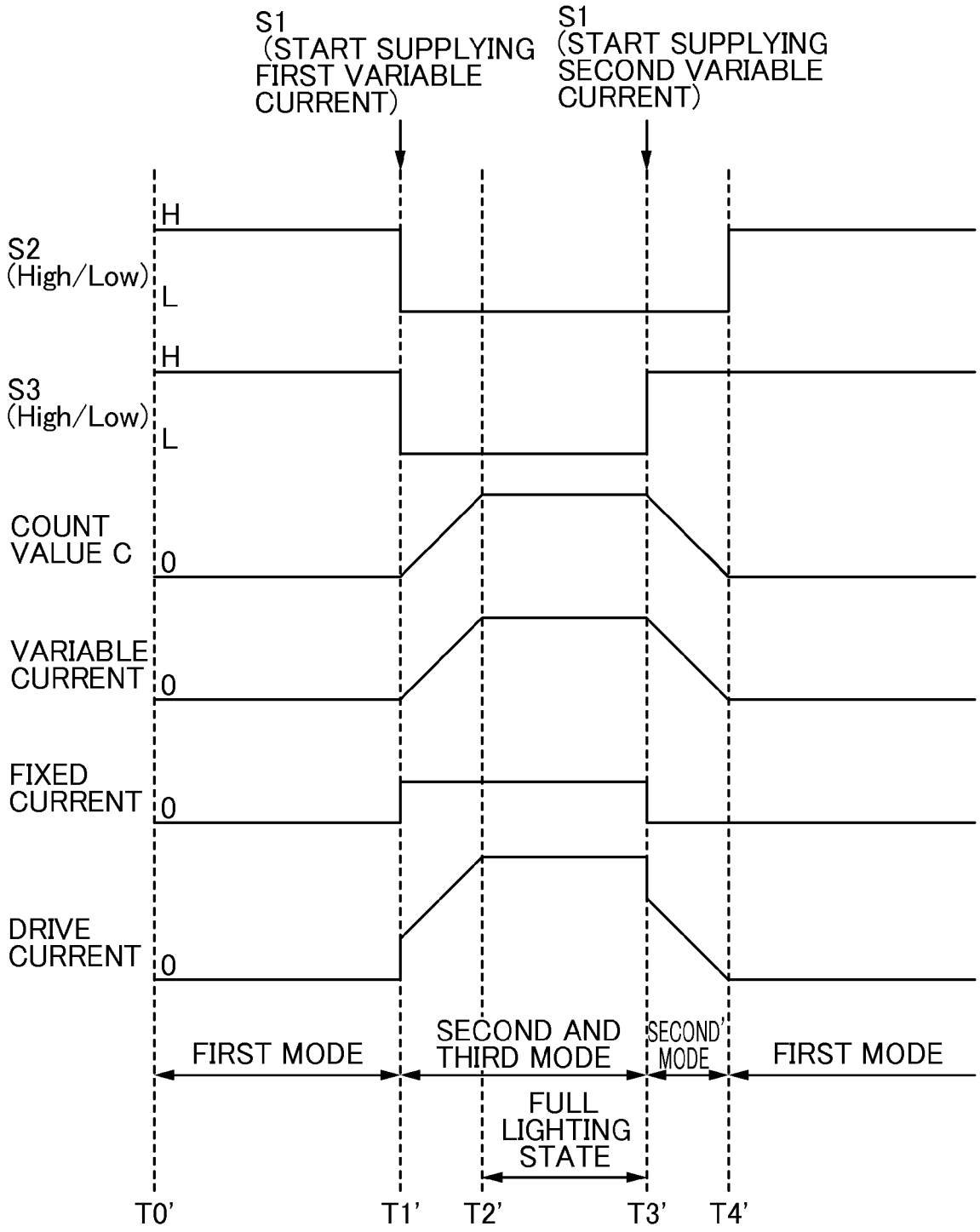
FIG. 4 is another waveform diagram of main signals for explaining an operation of a light emitting element control circuit according to a first and second embodiments of the present invention.

FIG. 4 depicts s case where the mode setting circuit 110 sets the modes for the variable current generation circuit 120 and the fixed current generation circuit 130 in the order of the first mode, the second and third modes, and the primed second mode, as an example of an operation of the light emitting element control circuit 100 according to an embodiment of the present invention.

First, the mode setting circuit 110 sets the first mode for the variable current generation circuit 120 and the fixed current generation circuit 130 as described above, so that the LED 1 is put into the light-out state (see time T0' to T1' of FIG. 4).

After setting the first mode for the variable current generation circuit 120 and the fixed current generation circuit 130, the mode setting circuit 110 sets the second and third modes as described above, so that the drive current of the LED 1 is gradually increased by the supply of the first variable current, from the state where no drive current is applied. That is, the LED 1 is changed from the light-out state to the predetermined lighting state by performing the fade-in function (see time T1' to T3' of FIG. 4). In accordance with the above mode setting order, there can be obtained such a light emission pattern that the LED 1 is changed from the light-out state to the predetermined lighting state by performing the fade-in function. Therefore, the fade-in function can be performed even in the case that the LED 1 is not put into the weak lighting state.

Description will then be made of a case where the mode setting circuit 110 sets the primed second mode for the variable current generation circuit 120 and the fixed current generation circuit 130. The mode setting circuit 110 outputs the signal S1 for giving the instruction for starting to supply the second variable current to the LED 1 to cause the up-down counter 121 to start to count down. The up-down counter 121 counts down from the count value C of "111111" to the count value C of "000000". Therefore, the signal S2 is low level until the count value C reaches the predetermined value "000000", and the signal S2 becomes high level when the count value C reaches the predetermined value "000000" (see time T4' of FIG. 4).

That is, after supplying to the LED 1 the second variable current varying in the direction of the gradual decrease in 64 steps corresponding to the counting down, the driver circuit 123 prohibits the supply of the second variable current to the LED 1 since the signal S2 is high level. The mode setting circuit 110 makes the signal S3 high level. Consequently, the fixed current generation circuit 130 prohibits the supply of the fixed current to the LED 1. Therefore, the LED 1 is changed from the state of receiving the supply of the fixed current and the first variable current to the state of receiving the supply of the second variable current concurrently with prohibition of the supply of the fixed current and finally to the state where no current is supplied. That is, after setting the second and third modes for the variable current generation circuit 120 and the fixed current generation circuit 130, the mode setting circuit 110 outputs the signal S1 for giving the instruction for starting to supply the second variable current to the LED 1 and makes the signal S3 high level to set the primed second mode, so that the fade-out function is performed, and thus, the LED 1 is changed from the predetermined lighting state to the light-out state.

As described above, there can be obtained such a light emission pattern that the LED 1 is changed from the predetermined lighting state to the light-out state by executing the fade-out function, in accordance with the above mode setting order. In other words, the fade-out function can be performed even in the case that the LED 1 is not put into the weak lighting state.

The light emitting element control circuit 100 can also set at least any one of the first to third modes at arbitrary timing to obtain light emission state patterns of the LED 1 other than those shown in FIGS. 3 and 4.

==Second Embodiment==

Figure 5:
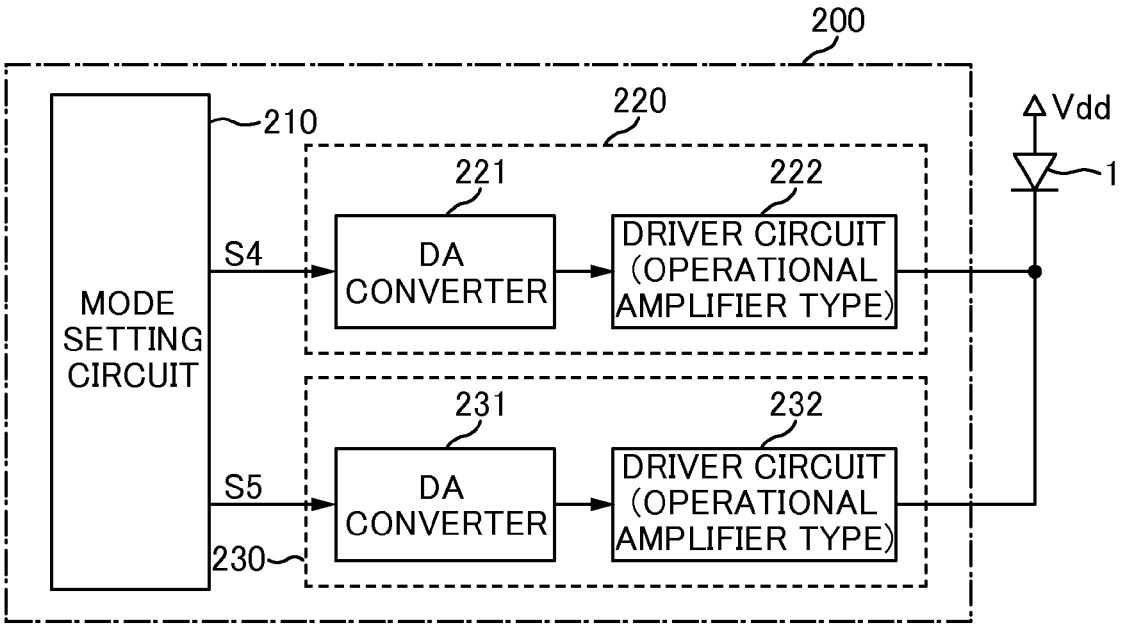
FIG. 5 is a block diagram of a configuration of a light emitting element control circuit according to a second embodiment of the present invention.
Figure 6:
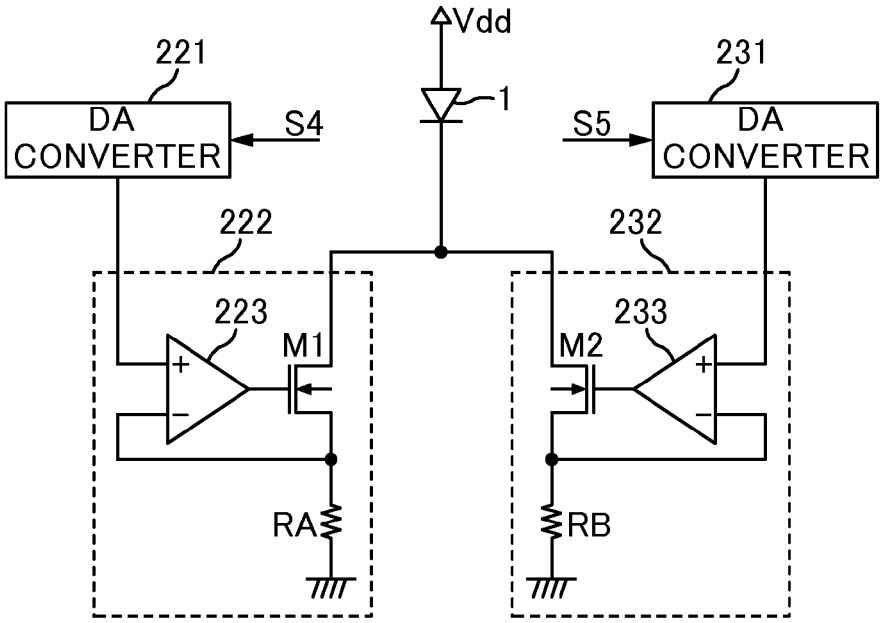
FIG. 6 is a diagram of detailed configurations of a first current generation circuit and a second current generation circuit of a light emitting element control circuit according to a second embodiment of the present invention.

FIG. 5 is a block diagram of an overall configuration of a light emitting element control circuit according to a second embodiment of the preset invention. In FIG. 5, a light emitting element control circuit 200 according to a second embodiment of the present invention is a configuration surrounded by alternate long and short dashed lines. FIG. 6 is a diagram of detailed configurations of a first current generation circuit 220 and a second current generation circuit 230 of the light emitting element control circuit according to the second embodiment of the preset invention.

The light emitting element control circuit 200 has a configuration with a driver circuit 222 of the first current generation circuit 220 and a driver circuit 232 of the second current generation circuit 230 connected in parallel with the cathode side of the LED 1. With such a configuration, the light emitting element control circuit 200 can obtain each of the weak lighting state and the predetermined lighting state as the light emission state pattern of the LED 1. The same reference numerals are added to the constituent elements same as those shown in the light emitting element control circuit 100 according to a first embodiment of the present invention of FIGS. 1 and 2, and the description of these constituent elements will be omitted.

The mode setting circuit 210 outputs a signal S4 to the first current generation circuit 220 when the LED 1 is driven to the predetermined lighting state. The mode setting circuit 210 outputs a signal S5 to the second current generation circuit 230 when the LED 1 is driven to the weak lighting state. The signal S4 gives an instruction for a magnitude of the LED drive current (predetermined current) for driving the LED 1 to the predetermined lighting state. The signal S5 gives an instruction for a magnitude of the LED drive current (fixed current) for driving the LED 1 to the weak lighting state.

The first current generation circuit 220 includes a DA converter 221 and a driver circuit 222, and generates the predetermined current for driving the LED 1 to the predetermined lighting state to be supplied to the LED 1.

The DA converter 221 converts the digital signal S4, for which the magnitude of the predetermined current is set and which is output by the mode setting circuit 210, from a digital value into an analog value (current value), to be supplied to the driver circuit 222. The predetermined current corresponds to a current corresponding to the magnitude of the analog value. The DA converter 221 may be a constant current source generating a predetermined current.

The driver circuit 222 includes an nMOSFET M1, a current-drive operational amplifier 223, and a resistor RA. The nMOSFET M1 has a drain electrode connected to a cathode electrode of the LED 1, a gate electrode connected to an output of the operational amplifier 223, and a source electrode connected to the resistor RA. The operational amplifier 223 has a non-inverting input thereof connected to an output of the DA converter 221 and an inverting input thereof connected to a connection point between the source electrode of the nMOSFET M1 and the resistor RA.

With the above configuration, the nMOSFET M1 drives the LED 1 based on the comparison result between the inverting input and the non-inverting input of the operational amplifier 223. Specifically, if a difference between the non-inverting input (output of the DA converter 221) and the inverting input (comparison voltage generated at one end of the resistor RA which is opposite the ground potential GND) of the operational amplifier 223 becomes greater, a greater LED drive current is passed through the LED, to increase the comparison voltage generated in the resistor RA connected to the inverting input of the operational amplifier 223. On the other hand, if the difference between the non-inverting input and the inverting input of the operational amplifier 223 becomes smaller, a smaller LED drive current is passed through the LED, to decrease the comparison voltage generated in the resistor RA connected to the inverting input of the operational amplifier 223. That is, the driver circuit 222 functions as a voltage regulator performing an adjustment such that an output voltage of the DA converter 221 becomes the comparison voltage generated in the resistor RA.

The voltage generated in the resistor RA by passage of the LED drive current is substantially equivalent to the cathode voltage of the LED 1. If the cathode voltage is increased, the anode voltage (Vdd) of the LED 1 is required to be increased in consideration of a forward voltage VF of the LED 1, however, efficiency is deteriorated in association with the increase in voltage. Especially, if the predetermined lighting state is defined as the full lighting state of the LED 1, since the cathode voltage is increased to the maximum, a tendency to deteriorate the efficiency becomes prominent. Therefore, the resistor RA with a small resistance value is required to be employed such that the minimum amount of the forward voltage VF of the LED 1 can be obtained when the LED 1 is put into the predetermined lighting state.

The second current generation circuit 230 includes a DA converter 231 and a driver circuit 232, and generates the fixed current for driving the LED 1 to the weak lighting state to be supplied to the LED 1.

The DA converter 231 converts the digital signal S5, for which the magnitude of the fixed current is set and which is output by the mode setting circuit 210, from a digital value into an analog value (current value), to be supplied to the driver circuit 232. The fixed current is substantially equivalent to a current corresponding to the magnitude of the analog value. The DA converter 231 may be a constant current source generating a predetermined current.

The driver circuit 232 includes an nMOSFET M2, a current-drive operational amplifier 233, and a resistor RB as is the case with the driver circuit 222. The nMOSFET M2 has a drain electrode connected to the cathode electrode of the LED 1, a gate electrode connected to an output of the operational amplifier 233, and a source electrode connected to the resistor RB. The operational amplifier 233 has a non-inverting input thereof connected to an output of the DA converter 231 and an inverting input thereof connected to a connection point between the source electrode of the nMOSFET M2 and the resistor RB.

With the above configuration, the nMOSFET M2 drives the LED 1 based on the comparison result between the inverting input and the non-inverting input of the operational amplifier 233. That is, the driver circuit 232 functions as a voltage regulator performing an adjustment such that an output voltage of the DA converter 231 becomes a comparison voltage generated in the resistor RB.

Assuming that the operational amplifier 233 has the same characteristics as those of the operational amplifier 223, a resistor with a resistance value greater than that of the resistor RA is required to be employed as the resistor RB of the second current generation circuit 230. That is, when the LED 1 is put into the weak lighting state, the LED drive current is smaller in amount than that in the case of putting the LED 1 into the predetermined lighting state, and therefore, the voltage generated in the resistor RB is reduced. In this case, an effect of an offset of the operational amplifier 233 is increased, and thereby causing greater variations in the LED drive current. Therefore, by increasing the resistance value of the resistor RB, the effect of the offset of the operational amplifier 233 can be restrained so that the variations in the LED drive current can be reduced.

==Third Embodiment==

Figure 7:
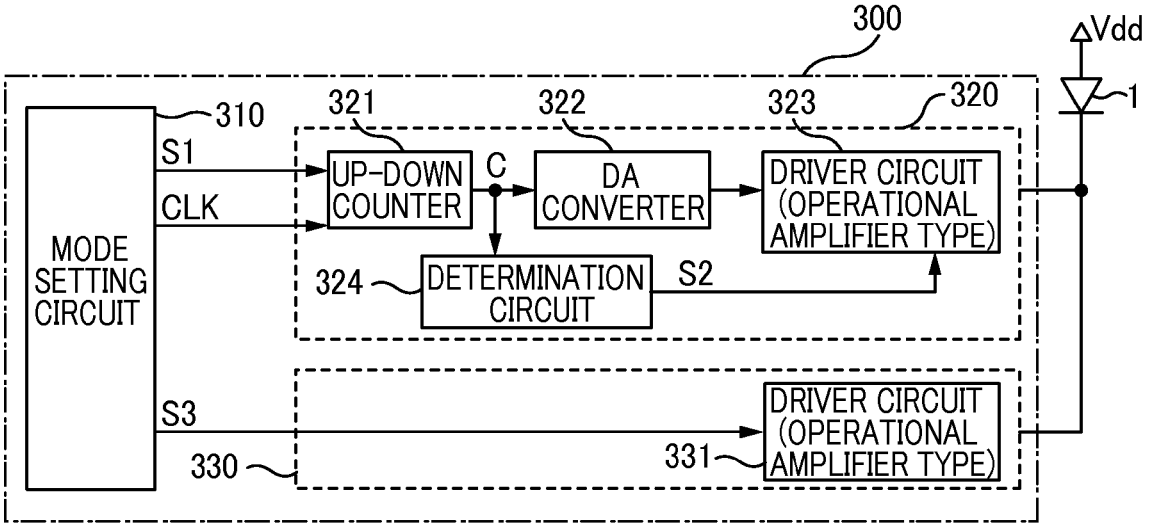
FIG. 7 is a block diagram of a configuration of a light emitting element control circuit according to a third embodiment of the present invention.
Figure 8:
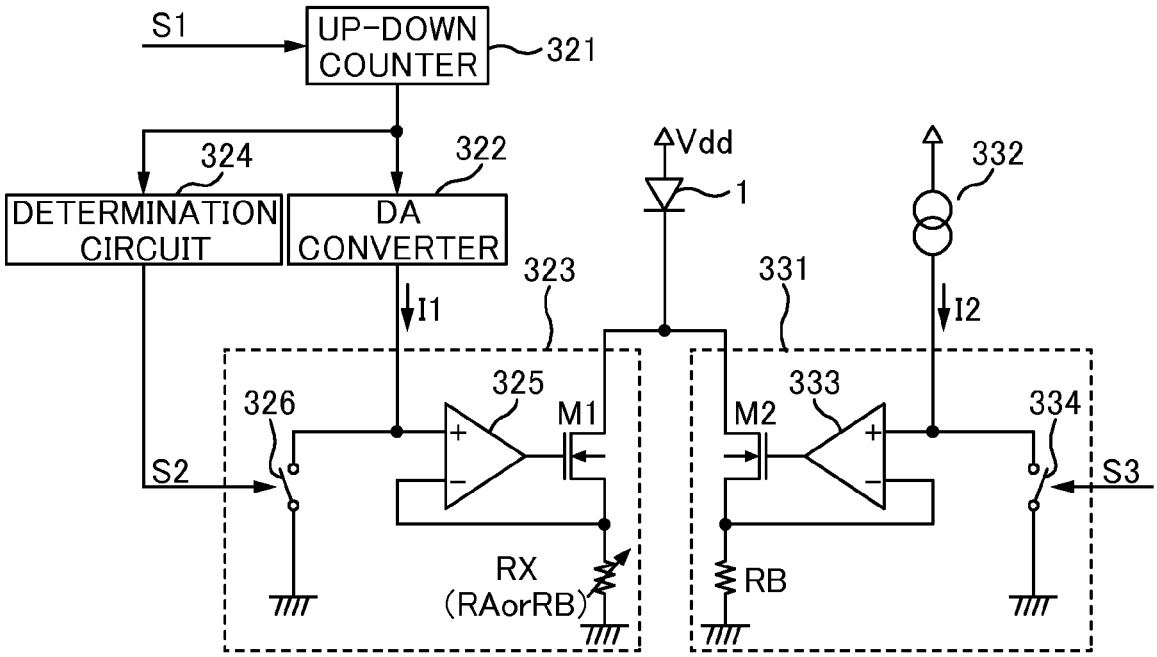
FIG. 8 is a diagram of detailed configurations of a variable current generation circuit and a fixed current generation circuit of a light emitting element control circuit according to a third embodiment of the present invention.

FIG. 7 is a block diagram of an overall configuration of a light emitting element control circuit according to a third embodiment of the preset invention. FIG. 8 is a diagram of exemplary detailed configurations of a variable current generation circuit and a fixed current generation circuit of the light emitting element control circuit according to the third embodiment of the preset invention.

A third embodiment according to the present invention has a configuration of a combination of a first embodiment and a second embodiment described above. That is, differences between a light emitting element control circuit 300 according to a third embodiment of the present invention and the light emitting element control circuit 100 according to a first embodiment thereof shown in FIGS. 1 and 2 are that a driver circuit 323 (current mirror type) of a variable current generation circuit 320 and a driver circuit 331 (current mirror type) of a fixed current generation circuit 330 are replaced with the driver circuit 222 (operational amplifier type) and the driver circuit 232 (operational amplifier type) of the light emitting element control circuit 200 according to a second embodiment shown in FIG. 6, and that the resistor RA making up the driver circuit 323 is replaced with a variable resistor RX.

A resistance value of the variable resistor RX is varied to become the resistance value of the above resistor RA or the resistance value of the above resistor RB based on magnitude of the variable current supplied to the LED 1. Specifically, when it is determined by a determination circuit 324 that the magnitude of the variable current supplied to the LED 1 based on an output of a DA converter 322 is equal to or less than the magnitude of the fixed current, the resistance value of the variable resistor RX is set to the same value as the resistance value of the resistor RB based on an output of the determination circuit 324. On the other hand, if it is determined by a determination circuit 324 that the magnitude of the variable current supplied to the LED 1 based on the output of the DA converter 322 is greater than the magnitude of the fixed current, the resistance value of the variable resistor RX is set to the same value as the resistance value of the resistor RA based on an output of the determination circuit 324. The determination circuit 324 and a third switch 326 are operated substantially in the same manner as the determination circuit 124 and a first switch 126 in FIG. 2, respectively. The fourth switch 334 operates substantially in the same manner as the second switch 132 in FIG. 2.

With the above configuration, a light emitting element control circuit 300 can also obtain the light emission state patterns of the LED 1 other than those shown in FIGS. 3 and 4 in addition to the light emission state patterns shown in FIGS. 3 and 4, by setting at least any one of the first to third modes in arbitrary timing. A resistor with a small resistance value can be employed as the resistor RA such that the minimum amount of the forward voltage VF of the LED 1 can be obtained when the LED 1 is put into the predetermined lighting state. On the other hand, a resistor with a resistance value greater than that of the resistor RA can be employed as the resistor RB, in order to restrain an effect of an offset of an operational amplifier 333 when the LED 1 is put into the weak lighting state in which the LED drive current is smaller in amount than that in the case of putting the LED 1 into the predetermined lighting state. That is, the variations in the LED drive current can be reduced to suitably set the light emission state pattern of the LED 1.

The above embodiments of the present invention are simply for facilitating the understanding of the present invention and are not in any way to be construed as limiting the present invention. The present invention may variously be changed or altered without departing from its spirit and encompass equivalents thereof.

For example, other than the LED 1, an organic EL element may be employed as a light emitting element controlled as to the light emission state by the light emitting element control circuit 100 (200, 300), or a plurality of the LEDs 1 each having different light emission colors respectively may also be employed. In association with the plurality of the LEDs 1, the number of the variable current generation circuits 120 (220, 320) and the fixed current generation circuits 130 (230, 330), which corresponds to the number of the plurality of the LEDs, can be provided, or the circuits 120 and 130 {(220 and 230), (320 and 330)} can be shared among the plurality of the LEDs to control the light emission state of each of the plurality of the LEDs. Specifically, the LEDs of three colors such as R, G, and B can be controlled as to the light emission state and the light emission states thereof can be combined to represent various colors.

If three-color LEDs are used, a luminance adjustment circuit may be provided for adjusting luminance of each of the three-color LEDs. The luminance adjustment circuit can be realized by multiplying luminance data for specifying the luminance of each of the three-color LEDs by the analog value output from the DA converter 122 (221, 322) to be supplied to the driver circuit 123 (222, 323). Therefore, the luminance patterns of the three-color LEDs can be changed by adjusting the LED drive current supplied to each of the three-color LEDs in accordance with the luminance data, and the multi-color and multi-tone display can be performed in the electronic devices provided with the three-color LEDs.

If the mode setting circuit 110 (310) sets the light emission states in the order of the first mode, the third mode, and the second and third modes for the variable current generation circuit 120 (320) and the fixed current generation circuit 130 (330), the LED 1 may be changed from the light-out state to be set in the determinate weak lighting state once, and then the fade-in function may be started to drive the LED 1 to be in the full lighting state.

That is, if the fade-in function is suddenly started from the light-out state, it is difficult to predict when the fade-in function is visually started by a minute current amount of the first variable current immediately after the start of the fade-in function, and the visual effect of the fade-in function may not appropriately be obtained. Therefore, by starting the fade-in function after setting the weak lighting state, which is visible to the naked eye, the visual effect of the fade-in function can appropriately be obtained. As a result, when a plurality of LEDs are used to perform the fade-in function, even if periods, from the time when the supplies of the first variable currents are started to the time when the visible light emission states are achieved, are different among the LEDs due to the characteristic variations thereof, the timings of starting the fade-in function can be synchronized among the LEDs.

The variable current generation circuit 120 (320) may include a frequency division circuit for dividing frequency of the counter clock CLK supplied from the mode setting circuit 110 (310) and a clock switching circuit. This enables the up-down counter 121 (321) to switch the frequency of the counter clock CLK for counting up and down to obtain the count value. A period during which the up-down counter 121 counts up from the count value of "000000" to the count value of "111111" with the counter clock CLK is a period required for a fade-in of the LED 1. That is, the period required for the fade-in can be varied by varying the frequency of the counter clock CLK. This also applies to the case of counting down. Therefore, time required for the fade-in or time required for the fade-out can be adjusted, so that the light emission state patterns of the LED 1 can be increased.

The fixed current generation circuit 130 may include a plurality of fixed current sources each outputting different fixed currents respectively. For example, other than the fixed current source 133, three fixed current sources are connected in parallel; respective switches are provided between the three fixed current sources and the current mirror circuit 131 connected thereto; and the mode setting circuit 110 outputs to the fixed current generation circuit 130 a signal for selectively turning on or off the respective switches. As a result, the magnitude of the fixed current can be switched in four levels, and therefore, the light emitting element control circuit 100 can select the weak lighting state of the LED 1 from four light emission states, so that the light emission state patterns of the LED 1 can be increased.

The fixed current generation circuits 130 can be provided with a plurality of current mirror circuits each having a different mirror ratio for the fixed current source 133. As a result, there can be generated a plurality of fixed currents having different magnitudes, so that the light emitting element control circuit 100 can increase patterns of the weak lighting state of the LED 1. Similarly, the fixed current generation circuit 330 can use the signal S3 to be input to the second driver circuit 331 to change setting for magnitude of the fixed current.

The fixed current generation circuit 130 (330) making up the light emitting element control circuit 100 (300) can be replaced with the variable current generation circuit 120 (320) that varies current within a range of the magnitude of the fixed current at the time of the above weak lighting state. As a result, the fade-in function can be performed in a process from the light-out state to the weak lighting state, and the fade-out function can be performed in a process from the weak lighting state to the light-out state. Therefore, the light emission state patterns of the LED 1 can be increased.

What is claimed is:

1. A light emitting element control circuit comprising:

a variable current generation circuit configured to selectively generate one of a first variable current varying in a direction of gradual increase and a second variable current varying in a direction of gradual decrease, the variable current generation circuit including:

an up-down counter configured to count up or down with a counter clock to obtain a count value, a DA converter configured to convert the count value into the variable current of an analog value, a first current mirror circuit configured to supply to the light emitting element a current corresponding to the variable current supplied from the DA converter, and a first switch circuit configured to control the variable current as to whether to prohibit supply from the DA converter to the first current mirror circuit;

a fixed current generation circuit configured to generate a fixed current smaller than a predetermined current of a light emitting element, the fixed current generation circuit including:

a second current mirror circuit configured to supply to the light emitting element a current corresponding to the fixed current supplied from a predetermined fixed current source, and a second switch circuit configured to control the fixed current as to whether to prohibit supply from the fixed current source to the second current minor circuit; and a mode setting circuit configured to selectively set a first mode of prohibiting supply of the first variable current, the second variable current, and the fixed current to the light emitting element, a second mode of supplying one of the first variable current and the second variable current to the light emitting element, and a third mode of supplying the fixed current to the light emitting element, for the variable current generation circuit and the fixed current generation circuit, wherein when setting the first mode for the variable current generation circuit and the fixed current generation circuit, the mode control circuit performs control for the first switch circuit so as to prohibit supply of the variable current from the DA converter to the first current minor circuit, and performs control for the second switch circuit so as to prohibit supply of the fixed current from the fixed current source to the second current mirror circuit, when setting the second mode for the variable current generation circuit and the fixed current generation circuit, the mode control circuit performs control for the up-down counter so as to count up or down to obtain a count value, and performs control for the first switch circuit so as to supply the variable current from the DA converter to the first current minor circuit, and when setting the third mode for the variable current generation circuit and the fixed current generation circuit, the mode control circuit performs control for the first switch circuit so as to prohibit supply of the variable current from the DA converter to the first current minor circuit, and performs control for the second switch circuit so as to supply the fixed current from the fixed current source to the second current minor circuit.

2. The light emitting element control circuit of claim 1, wherein the mode setting circuit changes the mode setting from the first mode to the third mode; and thereafter, when the third mode is continued for a predetermined period, the mode setting circuit changes the mode setting from the third mode to the second and third modes for generating the first variable current to put the light emitting element into a full lighting state.

3. The light emitting element control circuit of claim 2, wherein the mode setting circuit sets the second and third modes for generating the second variable current during a period from a time when the light emitting element is in the full lighting state to a time when the light emitting element is supplied with the fixed current; and when the light emitting element is supplied with the fixed current, the mode setting circuit changes the mode setting from the second and third modes for generating the second variable current to the third mode; and when the third mode is continued for a predetermined period, the mode setting circuit changes the mode setting from the third mode to the first mode to put the light emitting element into a light-out state.

4. The light emitting element control circuit of claim 1, wherein the fixed current generation circuit generates a plurality of the fixed currents having magnitudes different from each other, and wherein the mode setting circuit selects any one of the plurality of the fixed currents when setting the third mode for the fixed current generation circuit.

5. The light emitting element control circuit of claim 1, wherein the variable current generation circuit and the fixed current generation circuit are included in each of a plurality of the light emitting elements having light emission colors different from each other, and wherein the mode setting circuit selectively sets the first mode, the second mode, and the third mode, for the variable current generation circuit and the fixed current generation circuit included in each of the plurality of the light emitting elements.

6. A light emitting element control circuit comprising:

a first driver circuit configured to drive a light emitting element based on a predetermined current of the light emitting element; and a second driver circuit configured to drive the light emitting element based on a fixed current smaller than the predetermined current, the first driver circuit including a first operational amplifier configured to compare a voltage corresponding to the predetermined current applied to one input terminal with a first comparison voltage applied to the other input terminal;

a first transistor configured to drive the light emitting element in accordance with a comparison result of the first operational amplifier; and a first resistor configured to generate the first comparison voltage by passage of a drive current of the light emitting element, and the second driver circuit including a second operational amplifier configured to compare a voltage corresponding to the fixed current applied to one input terminal with a second comparison voltage applied to the other input terminal;

a second transistor configured to drive the light emitting element in accordance with a comparison result of the second operational amplifier; and a second resistor configured to generate the second comparison voltage by passage of a drive current of the light emitting element, the second resistor having a resistance value greater than a resistance value of the first resistor.

* * * * *

UNITED STATES PATENT AND TRADEMARK OFFICE

CERTIFICATE OF CORRECTION

PATENT NO. : 8,305,006 B2
APPLICATION NO. : 12/200752
DATED : November 6, 2012
INVENTOR(S) : Takaaki Ishii and Nobuyuki Ohtaka It is certified that error appears in the above-identified patent and that said Letters Patent is hereby corrected as shown below:

Column 14, line 23: replace --minor-- with “mirror”.

Column 14, line 38: replace --minor-- with “mirror”.

Column 14, line 48: replace --minor-- with “mirror”.

Column 14, line 54: replace --minor-- with “mirror”.

Column 14, line 57: replace --minor-- with “mirror”.

Signed and Sealed this
First Day of January, 2013

David J. Kappos

David J. Kappos
*Director of the United States Patent and Trademark Office*